United States Patent [19]

Haringer

[11] Patent Number: 4,693,662

[45] Date of Patent: Sep. 15, 1987

[54] COMPACT EXCAVATOR

[75] Inventor: Luis Haringer, Neumarkt, Italy

[73] Assignee: Macmoter S.p.A, Modigliana, Italy

[21] Appl. No.: 780,968

[22] Filed: Sep. 25, 1985

[30] Foreign Application Priority Data

Oct. 1, 1984 [DE] Fed. Rep. of Germany ..... 3435981

[51] Int. Cl.[4] ..... E02F 3/38

[52] U.S. Cl. ..... 414/695; 414/695.5; 414/917

[58] Field of Search ..... 414/694, 687, 691, 911, 414/695, 917, 695.5

[56] References Cited

U.S. PATENT DOCUMENTS 3,848,756 11/1974 Schaeff .

FOREIGN PATENT DOCUMENTS 1484752 12/1970 Fed. Rep. of Germany .
1634994 9/1971 Fed. Rep. of Germany .
2612879 9/1977 Fed. Rep. of Germany .
2757968 11/1979 Fed. Rep. of Germany .
3234020 3/1984 Fed. Rep. of Germany .
1603020 4/1971 France .
2092102 8/1982 United Kingdom .
2126982 4/1984 United Kingdom .

*Primary Examiner*—Robert J. Spar
*Assistant Examiner*—P. McCoy Smith
*Attorney, Agent, or Firm*—W. G. Fasse; D. H. Kane, Jr.

[57] ABSTRACT

A compact excavator has a superstructure, a swinging or swivelling mechanism connecting said superstructure with a chassis for swinging said superstructure relative to said chassis about a vertical axis, and a boom on said superstructure. The boom is linked to the superstructure directly by a parallel guide having a parallelogram link (14 or 14') and an intermediate member (12). The parallel guide is able to swing about a vertical axis (13', 13'') secured to the superstructure (3). The intermediate member (12) has a fixed length and the parallelogram link (14, 14') may have a fixed length link or a hydraulic actuator piston cylinder having a variable length. Such a construction simplifies additional movements required of the driver for operating the excavator.

9 Claims, 10 Drawing Figures

COMPACT EXCAVATOR

FIELD OF THE INVENTION

The invention relates to so-called compact excavators of the type comprising a superstructure mounted on a chassis by means of a mechanism for swinging or slewing the superstructure, on which a multi-part boom is mounted for swinging about at vertical axis, the boom comprising an intermediate member capable of swinging about a vertical axis.

DESCRIPTION OF THE PRIOR ART

Examples of such excavators are disclosed in the German Patent Publication (DE-OS) 1,484,752 and in the British Patent Publication (GB) 2,092,102.

These publications disclose the concept of constructing a part of the boom in the form of parallelogram links making possible a lateral offsetting of the boom.

However, in this case the two parallelogram links are conventionally designed as rigid elements.

In order to make possible an additional lateral swinging of a following part of the boom, it is necessary to have an additional link member as is disclosed in the British Patent Publication (GB) 2,092,102.

OBJECT OF THE INVENTION

It is one object of the present invention ot make possible a free mobility of a boom.

SUMMARY OF THE INVENTION

According to the invention a boom, such as an excavator boom, has two parallelogram links, one of which is able to be adjusted in length, that is to say, it comprises a hydraulic cylinder actuator or is formed by an actuator cylinder and its piston rod.

The boom member constructed in this way may be directly mounted on the superstructure of an excavator.

Further features of the invention are defined in the dependent claims.

It is particularly convenient if the intermediate member pivots on the superstructure at a position next to the driver's cabin. This feature leads, among other things, to a shorter overall length and better utilization of the counter-weight.

BRIEF DESCRIPTION OF THE DRAWINGS

Working examples of the invention will now be described with reference to the accompanying drawings, wherein.

DETAILED DESCRIPTION OF PREFERRED EXAMPLE EMBODIMENTS AND OF THE BEST MODE OF THE INVENTION

Figure 2:
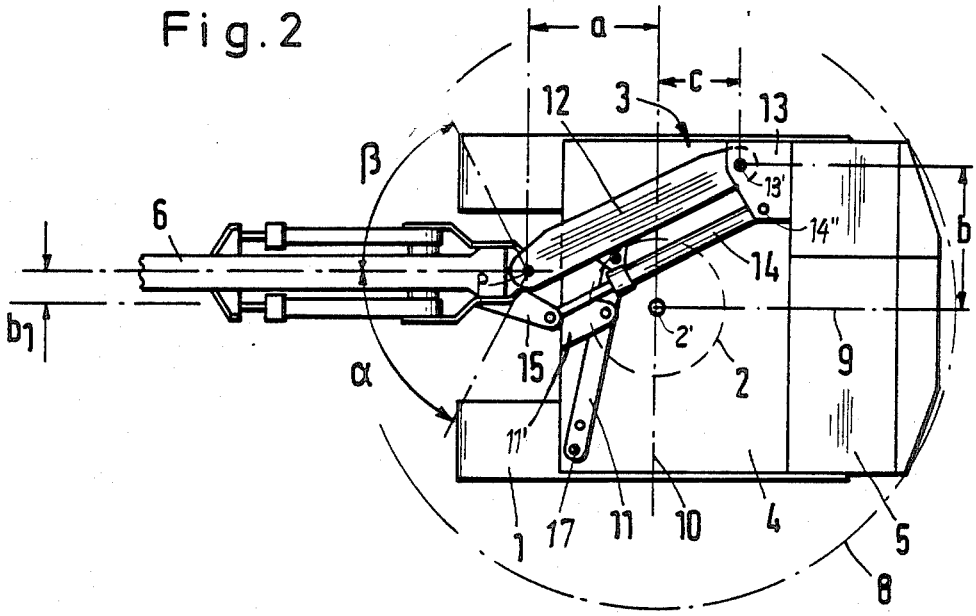
FIG. 2 is a plan view of the excavator of FIG. 1 with the boom in the non-working state and showing the parallelogram guide with a hydraulic link.
Figure 1:
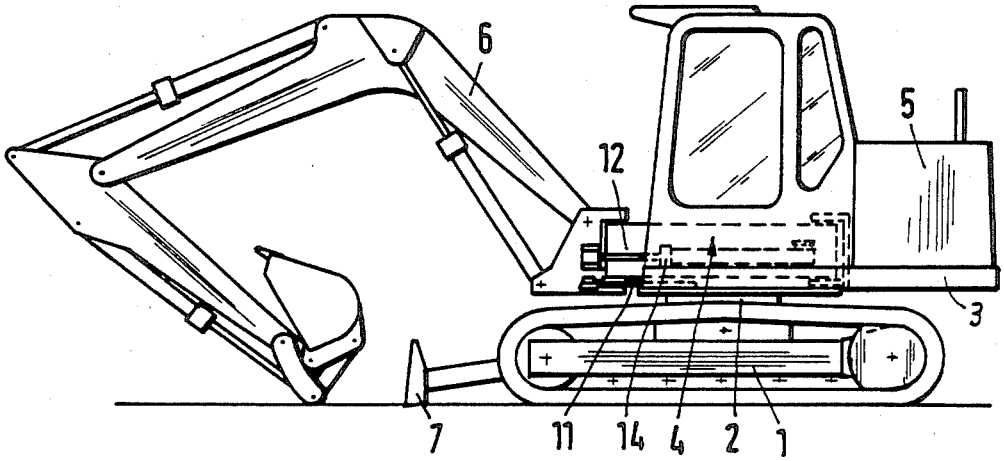
FIG. 1 is a side view of an excavator in accordance with the invention having a horizontal parallelogram guide for its boom.

Referring first to FIGS. 1 and 2, the present excavator has a superstructure 3 mounted on a chassis 1 for swivelling by means of a journal mechanism or drive 2. The superstructure 3 supports a driver's cabin 4, a body 5 in the form of a housing for a drive engine, a counterweight and a mount for a boom 6.

The present invention is concerned with so-called compact excavators, which are produced with such small dimensions that the superstructure is not very much longer than the chassis. Furthermore, a small excavator ususally has at least one support outrigger, for example a working blade 7, can function as an outrigger. A clearance circle 8 as marked in FIG. 2, is defined as a circle along which the projecting parts, excluding the boom, of the superstructure rotate. The longitudinal center axis 9 of the body 5 coincides approximately with that of the boom 6. The transverse axis 10 of the superstructure passes through the pivot point 2' of the journal axis of the superstructure 3. The pivot point 2' does not always coincide with the center of the chassis 1 because the chassis frequently has to contribute to the static weight distribution of the excavator.

The boom 6 is arranged to pivot about a vertical journal axis P, which is located on the longitudinal center axis 9 or is to the side thereof, i.e. is asymmetric as shown in FIG. 2.

The boom 6 is able to swing through the angles $\alpha$ and $\beta$ to both sides. The mounting point or journal axis P is spaced by a distance "a" from the pivot point or axis 2' of the superstructure and is also spaced by a distance $b_1$ to the side of the longitudinal center axis 9. The distance $b_1$ may range from zero to the breadth of the chassis 1. The swinging of the boom around the mounting point or journal axis P is normally brought about by a hydraulic drive although manual swinging using a stay 11 for locking is also possible. When the boom 6 is not in use, its position may be locked by connecting the stay 11 to a bracket 11' as shown in FIG. 2.

Figure 9:
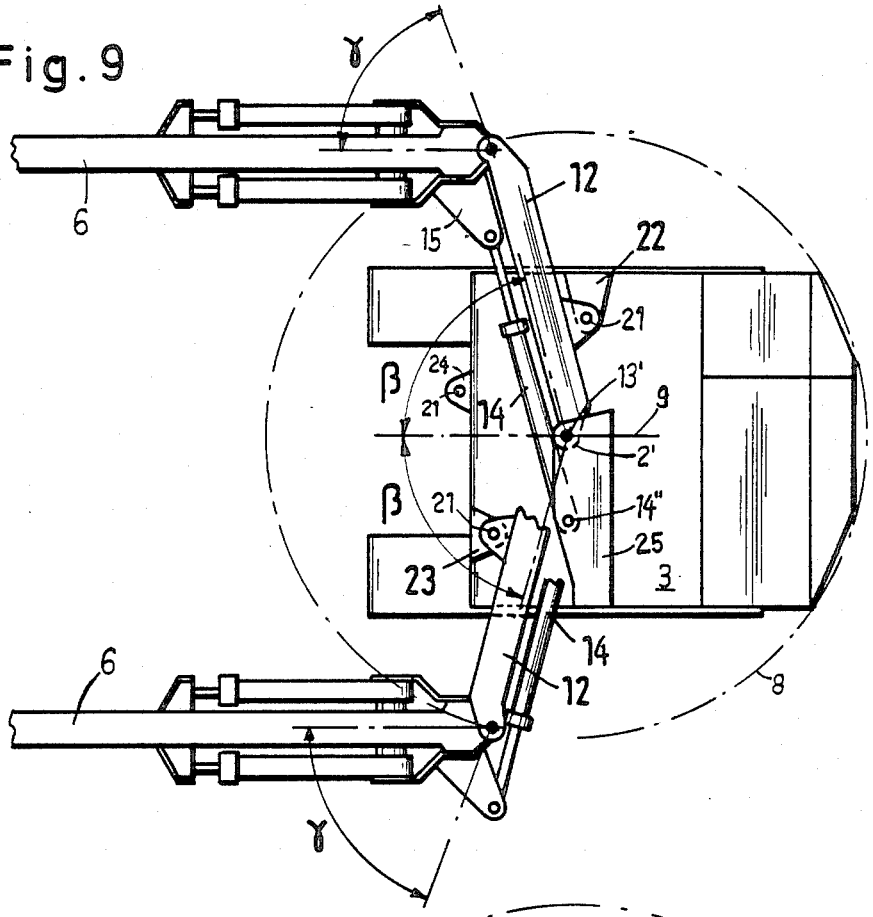
FIG. 9 is a plan view of yet another embodiment of the invention with modified mounting brackets and showing the boom in two different working positions.
Figure 10:
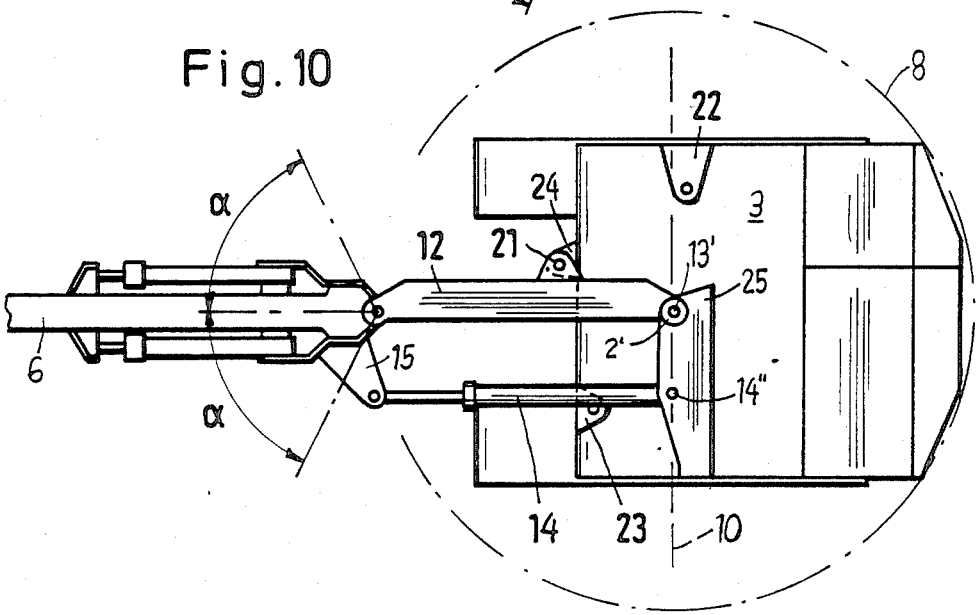
FIG. 10 is a view looking down onto the excavator of FIG. 9 in the non-operative position.

It is known to pivotally mount a boom on the superstructure by means of an intermediate member, which is mounted on a pivot socket. According to the invention a distance "c" as measured in the longitudinal direction between a pivot axis 13' and the transverse axis 10 through the pivot axis 2', and a lateral offset "b" from the central axis 9, define the location of the pivot axis 13' to the right of the transverse axis 10 as shown in FIGS. 2, 3, 4, 5, 6, 7, and 8. In FIGS. 9 and 10 the pivot axis 13' is located on the transverse axis 10, and coincides with the pivot axis 2' of the superstructure 3.

In accordance with the invention the boom 6 is connected to the socket 13 by a parallel guide comprising an intermediate member 12 and a parallelogram link 14 or 14'. In the drawings this parallel guide is so located that the member 12 and the parallelogram link 14 or 14', one end of which is attached by a journal 14" to the bearing socket 13 and the other end of which is journalled to a headpiece 15 forming part of the boom 6, are both located in the same horizontal plane. As shown in the Figures, according to the invention both pivot or journal axes 13' and 14" are located to the rear of the transverse axis 10 or on the transverse axis 10.

The particular tasks to which a compact excavator are likely to be assigned are operations where space is at a premium, as for example in narrow streets or on sidewalks involving the digging of trenches in any desired relative position and direction, and furthermore to make it possible for a vehicle to be loaded with dug out material, even if the trench is close to a wall or extends normal thereto.

Figure 3:
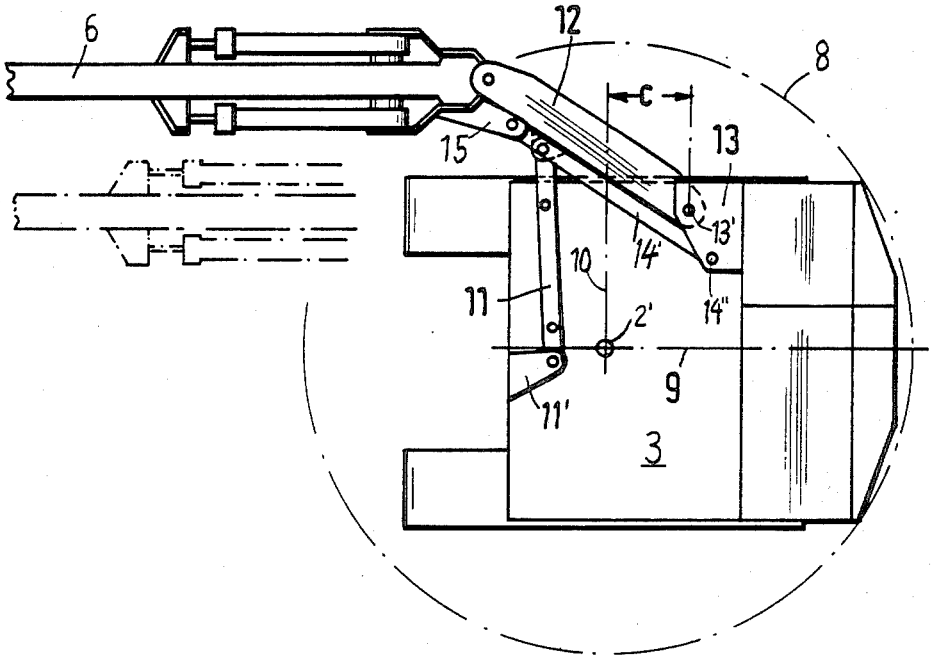
FIG. 3 is a plan view of another example of the invention illustrating the boom in two different working positions and showing a parallelogram guide with two links of fixed length.
Figure 4:
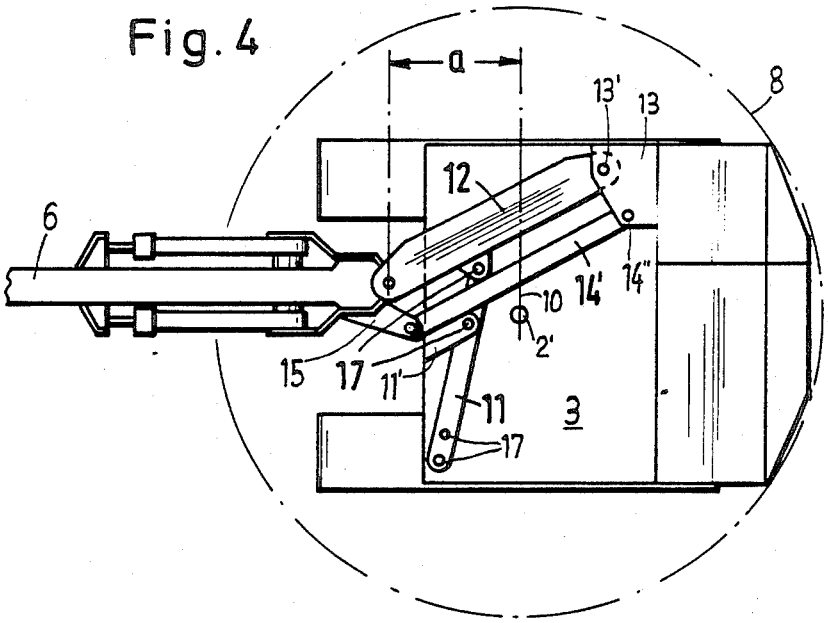
FIG. 4 is a plan view of the excavator of FIG. 3 in the non-working position similar to FIG. 2.

In the embodiments of the invention the basic construction of the excavator is generally as shown in FIGS. 1 and 2. In all embodiments the boom 6 is connected to the superstructure 3 directly by the parallel guide comprising either a member 12 of fixed length and an extendable link 14, or two members 12 and 14' of fixed length. The swinging and locking stay 11 has a number of holes 17 to receive pins or studs to lock the intermediate member 12 on the superstructure 3 in a given position of swinging, the boom moving parallel to the longitudinal center axis 9 when swinging between such positions. The offset "c" contributes to a greater stability and better use of the counter-weight. In FIGS. 3 and 4 the member 12 and the parallelogram link 14' have both a fixed length.

Figure 5:
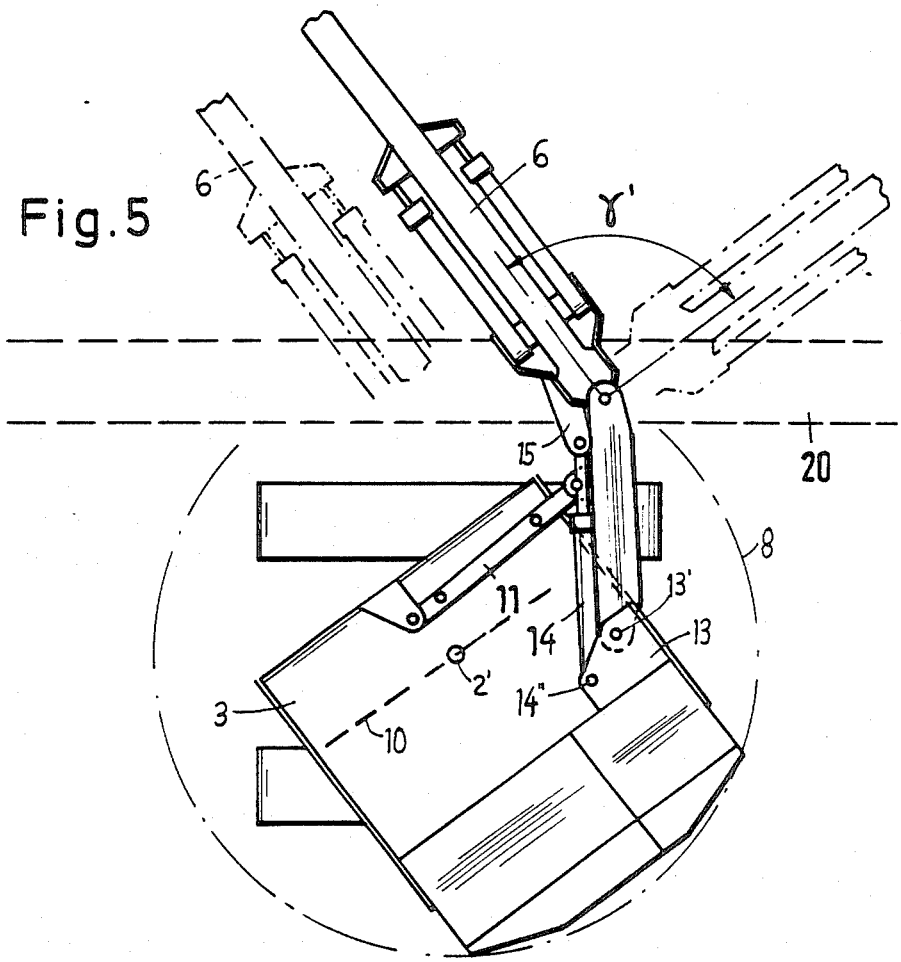
FIG. 5 is a plan view of the embodiment of FIGS. 1 and 2 in different working positions illustrating the lateral reach of the boom.
Figure 6:
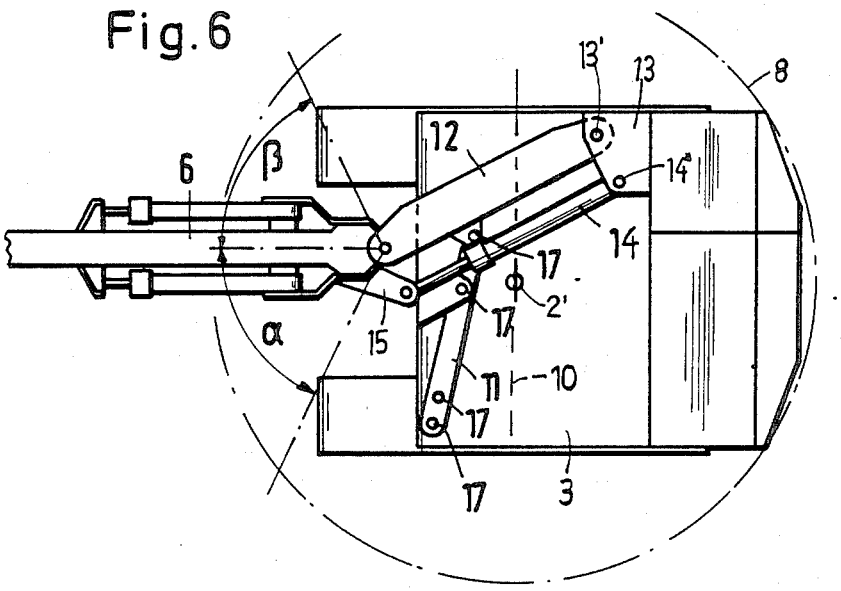
FIG. 6 is a plan view of the excavator of FIG. 5 in the non-working position similar to FIG. 2.

The embodiment of the invention illustrated in FIGS. 5 and 6 comprises an extendable parallelogram link in the form of a hydraulic cylinder actuator 14 just as in FIGS. 1 and 2 in place of the rigid parallelogram line 14' in FIGS. 3 and 4. The extendable link or actuator 14 makes possible an additional excursion of the boom 6 through an angle $\alpha'$. The holes 17 in the locking stay 11 again permit the locking of the boom 6 in the extended position even with the superstructure 3 in the swivelled position shown in FIG. 5. It will be seen from FIG. 5 that it is not only possible to excavate a trench 20 parallel to the longitudinal extension of the running gear of the excavator but also a trench within a wide area at any desired angle to the longitudinal asis.

Except for FIG. 5 the views show the excavator without any swivelling of the superstructure 3 so that it is in the straight ahead setting. In will be seen that the parallelogram guiding system and its location on the superstructure 3 makes possible an operation which would otherwise only be feasible with known excavators after swivelling the superstructure 3 and the boom 6. Fewer control operations are therefore needed for an excavator of the invention for most jobs. Furthermore, the fact that the clearance circle 8 may be larger, does not have any undesired effect, since the superstructure 3 may not have to be swivelled for unloading an excavated batch.

Figure 7:
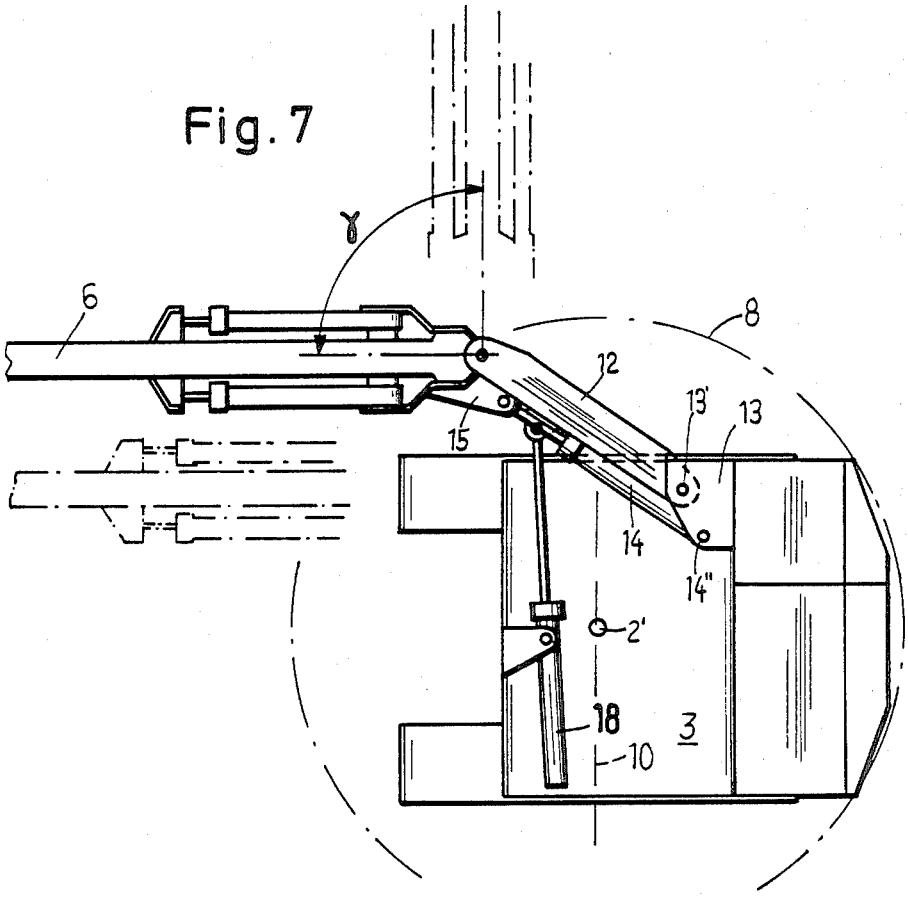
FIG. 7 is a plan view of a further embodiment of the invention having an extendable stay member and illustrating different working positions of the boom.
Figure 8:
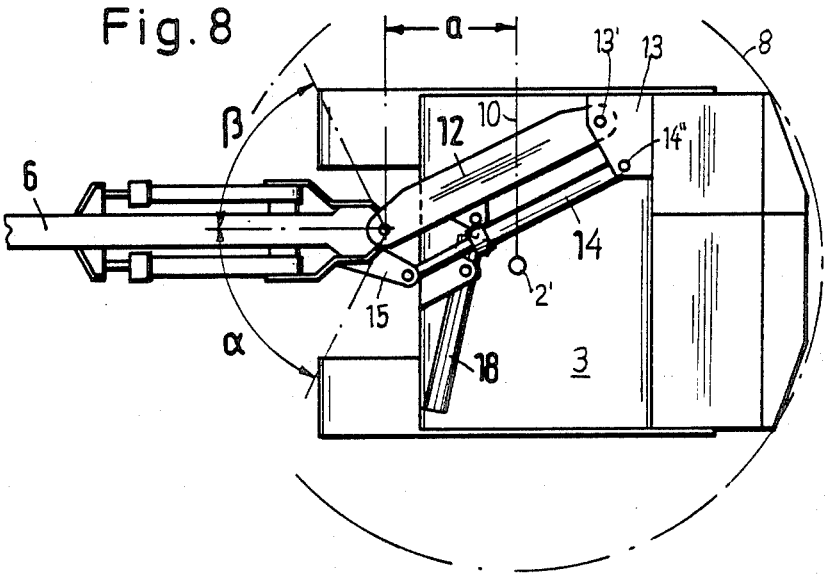
FIG. 8 is a view from above of the excavator as depicted in FIG. 7 in the non-working position.

In the example of FIGS. 7 and 8, the locking stay 11 is replaced by a piston cylinder actuator 18 so that the intermediate member 12 may be swung into any desired position without having to swivel the superstructure 3 at the same time.

The embodiment of FIGS. 9 and 10 differs in some respects from the other embodiments of the invention. Firstly, the intermediate member 12, unlike in known structures, is pivoted at 13' to a vertical axis in a bracket 25 of the superstructure 3 exactly in the axis 2' of pivoting of the superstructure 3 and may be locked in the non-operational condition by means of a pin 21 in a number of settings using holes in projections 22, 23, or 24 respectively. The parallelogram link 14 in the form of an extendable piston cylinder device is also pivoted or journalled to a vertical axis 14" in the bracket 25 of the superstructure 3. The intermediate member 12 and the parallelogram link 14 forming the parallel guide are in this case able to swing in both directions through the same angle $\beta$, that is to say through about 75 degrees, whereas the boom 6 is able to swing using the hydraulic cylinder acutator 14 serving as a parallelogram link, through the angle $\alpha$ equal to $\gamma$. Stated differently, the boom 6 is able to pivot through about 60 degrees as far as the intermediate member 12.

For swinging or swivelling the intermediate member 12 with its extendable link 14 it would also be possible to utilize a rotary drive or a pair of reversible hydraulic actuators 18 as shown in FIGS. 7 and 8.

In these examples of the invention the intermediate member 12 is placed between the superstructure 3 and the boom 6, although it would also be possible to have it and its parallelogram link 14 or 14' between parts of the boom.

Although the invention has been described with reference to specific example embodiments, it will be appreciated, that it is intended to cover all modifications and equivalents within the scope of the appended claims.

I claim:

1. A compact excavator, comprising a chassis (1), a superstructure (3), and swivel journal means (2) for securing said superstructure (3) to said chassis (1), said swivel journal means defining a vertical axis (2') through which a transverse axis (10) extends horizontally across the excavator and perpendicularly to a normal forward travel direction of the excavator, a boom (6) for carrying excavator means, parallel guide means for directly securing said boom to said superstructure (3), said parallel guide means comprising a fixed length member (12) and a parallelogram link (14, 14') arranged to extend substantially in a common horizontal plane with said fixed length member (12), first vertically extending means for pivotally connecting forward ends of said fixed length member (12) and of said parallelogram link (14, 14') to said boom, and second vertically extending journal means (13' and 14") located at a location at least as far rearwardly as said transverse axis (10) when said superstructure (3) has its front end aligned substantially in parallel with, and facing in the same direction as, a front end of said chassis, said second vertically extending journal means directly journalling rearward ends of said fixed length member (12) and of said parallelogram link (14, 14') to said superstructure at said location at least as far rearwardly as said transverse axis (10) for an increased mobility and stability of said boom (6).

2. The excavator of claim 1, wherein said second vertically extending means for journalling comprise two journal axes (13' and 14") both of which are located rearwardly of said transverse axis (10).

3. The excavator of claim 1, wherein said second verticlly extending journal means for journalling comprise two journal axes (13' and 14") located on said transverse axis (10), at least one journal axis of said two journal axes coinciding with said vertical axis (2') of said swivel journal means.

4. The excavator of claim 1, wherein said parallelogram link is a link (14) of fixed length.

5. The excavator of claim 1, wherein said parallelogram link comprises an extendable piston cylinder device of variable length.

6. The excavator of claim 1, further comprising means (11, 18) pivotally connected to said superstructure (3) and to said fixed length member (12) of said parallel guide means for swivelling said boom (6) into an operating position by horizontally diplacing said parallel guide means in said common horizontal plane.

7. The excavator of claim 6, wherein said swivelling means comprise a rigid arm (11) with a number of holes (17) in said arm, and pins extendable through any one of said holes for locking said boom in any one of several fixed positions as determined by the number of said holes.

8. The excavator of claim 6, wherein said swivelling means comprise an extendable piston cylinder device (18) for swivelling said boom into a working position.

9. The excavator of claim 1, further comprising a plurality of projections (22, 23, 24) on said superstructure and means (21) for locking said parallel guide means to any one of said projections to lock said boom in different operating positions.

* * * * *